US005979534A

United States Patent [19]

Shibata et al.

[11] Patent Number: 5,979,534

[45] **Date of Patent: *Nov. 9, 1999**

[54] DIE CASTING METHOD

[75] Inventors: Ryoichi Shibata, Ishibashi-machi; Tomomi Souda; Takao Kaneuchi, both of Mooka; Hideya Yamane, Utsunomiya, all of Japan

[73] Assignee: Hitachi Metals, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/620,346

[22] Filed: Mar. 22, 1996

[30] Foreign Application Priority Data

Mar. 22, 1995 [JP] Japan ..... 7-062428
Dec. 4, 1995 [JP] Japan ..... 7-315265

[51] Int. Cl.[6] ..... B22D 17/08

[52] U.S. Cl. ..... 164/113; 164/900

[58] Field of Search ..... 164/113, 312, 164/900, 71.1, 493, 513, 498, 147.1

[56] References Cited

U.S. PATENT DOCUMENTS

| | | | |
|---|---|---|---|
| 4,565,241 | 1/1986 | Young | 164/900 |
| 4,832,112 | 5/1989 | Brinegar et al. | 164/499 |
| 5,579,825 | 12/1996 | Shibata et al. | 164/900 |

FOREIGN PATENT DOCUMENTS

| | | |
|---|---|---|
| 3-47951 | 7/1991 | Japan . |
| 4-69501 | 11/1992 | Japan . |
| 6-83888 | 10/1994 | Japan . |
| WO 9213662 | 8/1992 | WIPO . |

OTHER PUBLICATIONS

International Search Report, (including Annex), PCT/FR 92/00083, European Patent Office, Jun. 4, 1992.

Patent Abstracts of Japan, vol. 13, No. 434 (M–875), JP1166874, Jun. 30, 1989, Akio Nakano, "Casting Device For Composite Metal Product".

Patent Abstracts of Japan, JP7051827, Feb. 28, 1995, Japan Steel Works Ltd., Hida Osamu "Method and Apparatus For Producing Low Melting Point Metal Product".

Abstract, vol. 14, No. 110, (M–943) (4053), Feb. 28, 1990, Appl. No. 63–144811, NKK Corp., Hironori Yamamoto, Dec. 18, 1989, "Casting Method For Semimolten Metal".

Patent Abstracts of Japan, vol. 9, No. 319 (M–439), JP60152358, Aug. 10, 1985, Akebono Brake Kogyo KK, Arai Katsuo, "Half–Melting High Pressure Casting Method".

*Primary Examiner*—Kuang Y. Lin
*Attorney, Agent, or Firm*—Sughrue, Mion, Zinn, Macpeak & Seas, PLLC

[57] ABSTRACT

The present invention relates to a die casting method in order to obtain aluminum alloy having high quality and excellent mechanical characteristics. Further, the present invention relates to a die casting method to produce such an aluminum alloy casting, wherein primary crystal of molten metal is substantially granulated in a casting sleeve so as to form a semi-molten status, and then filled under pressure into a die cavity and solidified, so that molten metal flow becomes laminar flow, thus making less air mixing, and casting can be made without oxides and solidified matter being filled into die cavity.

18 Claims, 11 Drawing Sheets

DIE CASTING METHOD

FIELD OF THE INVENTION

The present invention relates to a die casting method to obtain aluminum alloy castings having high quality and excellent mechanical characteristics.

BACKGROUND OF THE INVENTION

In the prior art, die casting method is well known as a casting technology to obtain aluminum alloy castings. This die casting method is a casting method to produce castings by filling molten metal in a casting sleeve into a precise metallic die cavity under pressure. According to this die casting method, there are advantages such as highly precise dimensions of castings, beautiful casting surface, availability of mass production and fully automatic production. For this reason, this method has been conventionally used mainly in the production of metal castings which have melting points below that of aluminum alloy.

However, this die casting method has had a problem that the mechanical strength of castings after casting solidification is apt to be deteriorated owing to:

1 Molten metal poured into the casting sleeve is cooled down rapidly within the inner wall of the casting sleeve, generating solidified debris, which is mixed into molten metal and cast;

2 Air in the casting sleeve is mixed into molten metal, causing blister (a phenomenon where mixed and pressurized gas inflates by thermal load to become blistering);

therefore, it cannot be applied to production of strength parts that require high strength.

In order to solve these problems, there are Special Die Casting Methods which include hot sleeve method where casting sleeve is heated in order to prevent the generation of solidified debris in the inner wall of the casting sleeve as described in the above 1, vertical die casting method which prevents air in casting sleeve as described in the above 2 from being mixed into molten metal, and the like. In addition, there is hot chamber die casting method, which is limited to the casting of zinc alloy or magnesium alloy with relatively low melting temperatures. Therefore, this method can not be applied to wide extent.

However, even in the Special Die Casting Methods mentioned above, when speed for filling the molten metal is high, molten metal in the casting sleeve becomes turbulent and catches gas, and is cooled down in the inner wall of the die cavity together with the gas, causing defect and thus deteriorating mechanical and other characteristics. In order to prevent this problem, it is necessary to make the filling speed extremely low, and in this case, insufficient flow of molten metal is caused. In addition, non-solidified portion is extracted during the development of dendrite, causing segregation at the thick wall portions as shown in FIG. 5, thereby deteriorating the mechanical and other characteristics of the cast.

Apart from the various die casting methods mentioned above, Japan Patent Publication No. H3-47951 discloses a die casting method where dies are fixed to form a cavity having a pouring gate at bottom, to which die arranged at the exit of a cylinder is connected so as to form a drawing to limit the flow of molten metal into the cavity. A port to supply molten metal from exterior is arranged at the center of the direction of central axial line of the cylinder equipped with this die, and a punch is slidably engaged, and a casting apparatus is formed. Molten metal is poured into the cylinder from the supply port, and molten metal is kept until liquid phase and solid phase co-exist, then is pushed and pressed by punch through die and into cavity. According to this die casting method, the following effects are expected:

1: The molten melt can be supplied to cylinder at a temperature only just above melting point, which is relatively lower than the temperature in other methods. Therefore, energy can be saved.

2: Since the temperature of molten metal is low, gas absorption is scarce, and there is no need of degassing process, and products have few gas cavity, 3: Molten metal in a state where liquid phase and solid phase coexist is pushed up by punch, so that it is subjected to plastic working in a semi-molten status while passing through the die to form drawing, while the liquid phase and solid phase are mixed. The punch subjects the solid phase to shear force thereby making the casting structure fine. Thus, products with excellent mechanical characteristics can be obtained.

4: Since the molten metal is processed in a semi-molten state, deformation resistance is less compared with forging method, and equipment costs are reduced.

However, in this die casting method disclosed in Japan Patent Publication No.H3-47951, the structure of semi-molten metal is not granulated in the casting sleeve, so that the difference of solute concentration is large, and it is possible that segregation occurs, as shown in variable density in FIG. 6. Even when the molten metal is filled in die cavity, since its structure refinement is insufficient, there is still much to be improved in its mechanical characteristics.

Further, when the speed to fill the molten metal is fast, molten metal in the casting sleeve becomes turbulent and trap gas, and when this molten metal is cooled down rapidly within the inner wall of the die cavity, mechanical and other characteristics are deteriorated, and castings characteristics become uneven. In order to prevent this problem, it is necessary to make the filling speed extremely low. In this case, insufficient flow of molten metal occurs.

On the other hand, with respect to automobiles, the improvement of fuel efficiency has recently become an extremely important problem from laws and regulations in the United States. From this points of view, automobile parts having light weight are needed. Naturally, automobile parts should be sufficiently strong, and from this viewpoint, when making the weight of the parts light by reducing the thickness of the wall, strengthening of raw material becomes an important subject.

However, since there have been problems as described above in the prior die casting method, aluminum alloy castings produced by this die casting method were too insufficient in strength to be applied for production of high strength parts such as automobile parts and the like.

SUMMARY OF THE INVENTION

In view of the problems mentioned above, the object of the present invention is to provide a die casting method that can produce aluminum alloy castings which enables casting work with preferable molten metal flow without contamination of air, and which prevents oxides and solidified debris from being filled into the die cavity.

In order to solve the problems mentioned above, the die casting method according to the present invention is characterized in that a primary crystal of molten metal is substantially granulated in the casting sleeve so as to form a semi-molten status, and is filled into a die cavity under pressure, and solidified.

In addition, in the present invention, it is preferred to construct at least part of the inner cylinder of the casting sleeve with a low thermal conductor, and thus cool down the casting sleeve.

Further, in the die casting method of the present invention, it is preferred to fill the molten metal into the die cavity under pressure after having the molten metal heated by electromagnetic stirring in the casting sleeve.

Moreover, it is preferred to make the inside of die cavity a reduced pressure and/or inert gas atmosphere at least when the semi-molten metal is being filled, and to make the atmosphere of said casting sleeve interior an inert gas atmosphere.

Other objects and advantages of the present invention will become apparent from the detailed description to follow taken in conjunction with the appended claims.

BRIEF DESCRIPTION OF THE DRAWINGS

In the accompanying drawings, there are shown illustrative embodiments of the invention from which these and other of its objectives, novel features, and advantages will be readily apparent.

In the drawings.

DETAILED DESCRIPTION OF THE INVENTION

Figure 1A:
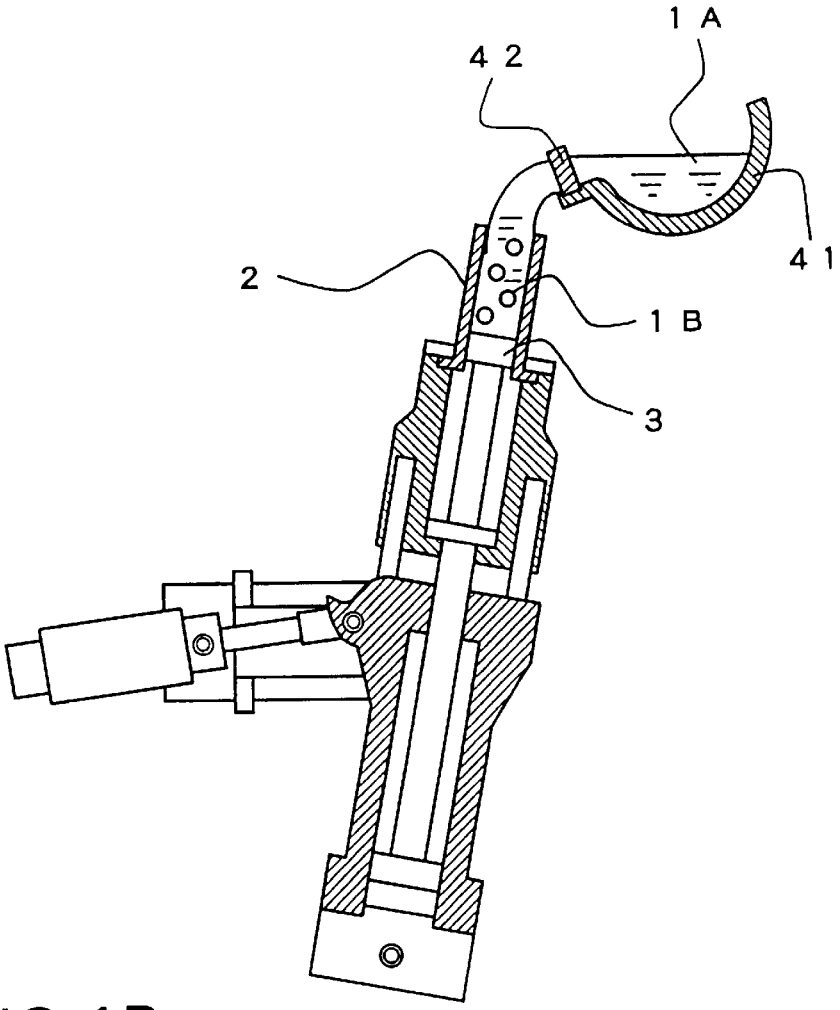
FIGS. 1(*a*)–(*b*) are diagrams showing cross section of an important portion of a vertical die casting machine, one example to be used in the die casting method of the present invention.

The invention is illustrated in further details by reference to the following referential examples and preferred embodiments thereof.

In the die casting method of the present invention, as a means to make the primary crystal of the molten metal substantially granular, the temperature of the molten metal in the casting sleeve is lowered from a temperature near liquid phase line to a temperature below liquid phase line but higher than solid eutectic line or eutectic line at a specified cooling speed.

Namely, in the aluminum alloy casting according to the present invention, the method to granulate primary crystal of the molten metal comprises of the following processes:

(a) process to melt metal and make its temperature near liquid phase line, (b) process to cast said molten metal and move it to the casing sleeve, then lower the temperature of said molten metal in the casting sleeve from a temperature near liquid phase line to a specified temperature lower than liquid phase line and higher than solid phase line or eutectic line at a specified cooling speed, and to granulate the primary crystal of the molten metal substantially so as to make the molten metal into a semi-molten state, (c) process to fill the semi-molten metal in said casting sleeve wherein the primary crystal is granulated into the die cavity under pressure, and (d) process to solidify the semi-molten metal filled into said die cavity.

As described above, in the present invention, metal is melt and cast at a temperature near liquid phase line and then moved to the casting sleeve, so that the casting sleeve is hardly damaged by high temperature. Further, in the process to lower the temperature of said molten metal in the casting sleeve from a temperature near the liquid phase line to a specified temperature lower than the liquid phase line but higher than solid phase line or eutectic line, it is not necessary to stir the molten metal by methods such as machine stirring or electromagnetic stirring. The metal is allowed to cool to the state where solid and liquid coexist, and primary crystal of molten metal is substantially granulated so as to form a semi-molten state. This semi-molten metal is injected into the die under pressure and solidifies. Accordingly, casting with excellent mechanical characteristics can be obtained without occurrence of blisters.

In the above mentioned die casting method, the temperature near liquid phase line is, for example, from around 10° C. below liquid phase line to about 40° C. above the liquid phase line in the case of A357 alloy.

At a temperature over the range mentioned above, dendrite grows, while at a temperature below range mentioned above, dendrite occurs before pouring the molten metal.

Next, the molten metal is cooled down so as to form a semi-molten status in the casting sleeve, and then in order to obtain granular primary crystal, the molten metal is cooled down at a specified cooling speed. It is preferable to set this cooling speed below 10 K/s. Thereby it is possible to granulate the primary crystal generated.

The concrete methods to cool down molten metal within a specified cooling speed are as described below:

(1) When the casting sleeve is formed by low thermal conducting material such as ceramic, the speed for cooling the sleeve surface is reduced, and the cooling speed in the sleeve interior is preferred to be below 10 K/s.

(2) In the case of metallic sleeve, it is desired to be preheated in order to raise initial temperature. Especially, in the case when A357 material is used, the initial temperature of the casting sleeve should be set at a temperature of over 200°C., and the cooling speed of the inner side of the molten metal is preferred to be below 10 K/s.

(3) The speed to cool the molten metal surface can be controlled and the interior of molten metal can be cooled down at a specified cooling speed by applying a cold crucible heating method which heats the molten metal surface by high frequency and cools the container while heating the molten metal.

Additionally, in the present invention, it is preferable to make the semi-molten metal which is granulated in the casting sleeve spheric during the process of filling the semi-molten metal into the cavity. Thereby, particles become finer, and molten metal flow becomes more preferable.

In this case, it is possible to make the semi-molten metal spheric by flowing the molten metal. As a means to flow molten metal, for example, there is a means to stir the molten metal by electromagnetic force. Also, by flowing the molten metal while it is being filled into the die cavity, the structure changes from particle status into spherical status.

Additionally, in the present invention, it is possible to give thixotropy to the molten metal by controlling the solid phase fraction of semi-molten metal in the casting sleeve from 30% to 60%, and thereby molten metal flow can be maintained preferably. Namely, thixotropy can be given to the molten metal by controlling the solid phase fraction of semi-molten metal at over 30%, and on the other hand, by setting the solid phase fraction of semi-molten metal below 60%, it is possible to prevent excessively high viscosity. Thereby, molten metal flow can be maintained preferably.

Further, in the present invention, it is preferable to form at least part of the inner cylinder of the casting sleeve by low thermal conducting material, and also to cool down the casting sleeve. Thereby, it is possible to control the cooling speed of molten metal and to make primary crystal granular. That is, by forming at least part of the inner cylinder of the casting sleeve by low thermal conducting material, it is possible to prevent heat dissipation of molten metal, and semi-molten and granular structure can be obtained without preheating casting sleeve.

The use of SIALON in the inner wall prevents the molten metal from wetting the casting sleeve.

Further, in the present invention, it is preferable to fill the semi-molten metal in the casting sleeve in a laminar flow status into the die cavity under pressure, and to give a higher pressure after then. Thereby, it is possible to prevent contamination of the gas into the semi-molten metal and also to prevent the occurrence of blister.

Additionally, it is preferable to reduce the pressure inside the die cavity and/or to inert gas atmosphere at least when the semi-molten metal is being filled, and to fill the inner side of said casting sleeve an inert gas atmosphere. Thereby, temperature can be controlled so as to keep the material in a semi-molten status, and surface oxidation can be prevented. Accordingly, products with fine qualities can be obtained without using special method to remove surface layer.

Further, in the die casting method of the present invention, it is preferable to dispose several conducting materials to at least part of the inner cylinder of said casting sleeve, so as to form a magnetic field by the induction coil at the exterior of said conducting materials, and to lower the temperature of said molten metal in the casting sleeve from a temperature near liquid phase line to a specified temperature lower than liquid phase line and higher than solid phase line or eutectic line, and heat or keep warm and stir the molten metal, then to fill the molten metal into said die cavity under pressure.

Thereby, current is introduced by electromagnetic induction in the semi-molten material. The conductive part, and the induced current and magnetic field interacts so as to keep the molten matter away from sleeve surface, thus preventing it from contacting the casting sleeve. Therefore, temperature decrease by contact between the molten matter and the casting sleeve can be reduced, and the occurrence of solidified debris on the surface of molten metal can also be reduced. Further, temperature distribution becomes uniform, and the temperature increase of the sleeve itself can be restricted, so that deformation of the casting sleeve becomes smaller, and the mechanical precision of the casting sleeve can be maintained.

In the above die casting method to obtain aluminum alloy casting of the present invention, thixotropy is given to molten metal, making the molten metal flow in a laminar flow so as to prevent air mixing, so that oxides or solidified debris can be prevented from being filled into the die cavity, and aluminum alloy casting with even characteristics can be obtained. The mechanism of this thixotrophy is described in detail hereinafter.

When the temperature of said molten metal in the casting sleeve is lowered from a temperature near liquid phase line to a specified temperature lower than liquid phase line and higher than solid phase line or eutectic line at a specified cooling speed the primary crystal of the molten metal is substantially granulated so as to form a semi-molten status. Thixotrophy can be obtained by the primary crystal in granular status and the liquid having a temperature above eutectic temperature. Thixotrophy is made by mixing granular solid and liquid in a certain ratio, and the phenomenon where a mixture liquidates by vibration and shear force, and solidifies when it is left alone.

In a status of such thixotropy, when force is given, there is a great tendency for molten metal to flows in laminar flow compared with a complete molten metal condition. Therefore, the occurrence of gas mixing while the molten is being filled from the casting sleeve into metallic die, becomes scarce. Namely, when a structure becomes granular and a solid phase exists to some extent, when force is applied, the movement of granulated solid phase and the movement of liquid occur at the same time, and solid and liquid move together. Thereby, defects of castings become fewer, gas content decreases, and blistering will not occur even heat processing. On the other hand, when the structure is not granular, when force is applied, the solid phase does not move, but only molten metal between solid phases, that is, the non-solidified portion. Therefore, segregation or air mixing occurs.

Such thixotrophy cannot be obtained merely by pouring molten metal into a sleeve at low temperature; it is necessary that the structure of the molten metal is granulated, and that the solid phase fraction gets high to some extent (generally over 30%). On the other hand, of the solid phase fraction gets excessively high (generally over 60%), viscosity increases, and molten metal flow becomes difficult.

EXAMPLES

Examples of aluminum alloy casting of the present invention are described in detail hereinafter.

(Example 1)

Figure 1B:
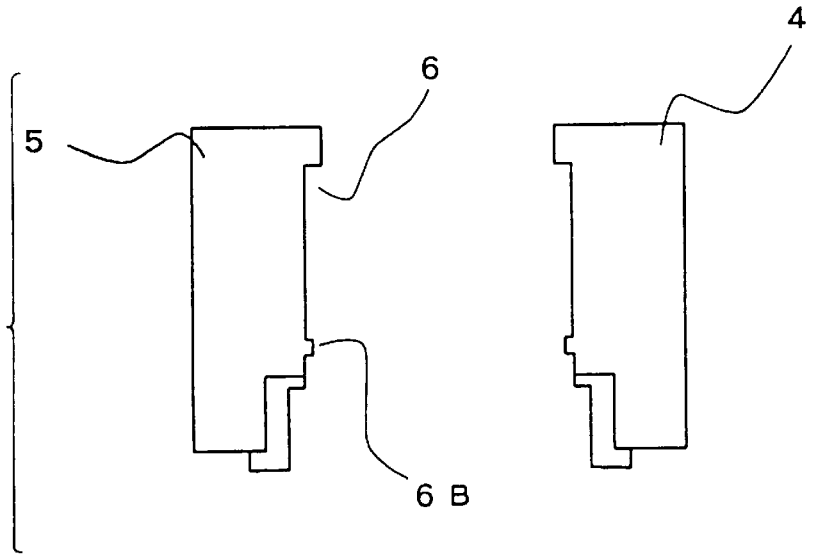

FIG. 1(*a*) shows a vertical die casting machine to be used in a die casting method to obtain aluminum alloy casting according to the present invention, while FIG. 1(*b*) shows a cross section of an important portion of a metallic die cavity. The pressure of the vertical die casting machine is 10 MPa, and the inner diameter of the casting sleeve 2 is 50 mm, while the outer diameter is 80 mm. Die cavity 6 is set by upper die 4 and lower die 5, so as to cast a steering knuckle, which is a suspension part of automobile.

By use of this vertical die casting machine, aluminum alloy casting of the present invention was produced by casting A357 alloy (ASTM:AlSi7% Mg). First, A357 alloy composition is melted and heated up to the temperature around 630° C. near liquid phase line (620° C.).

Next, this A357 alloy molten metal 1A is moved by ladle 41 to a casting sleeve 2 through filter material 42 arranged at the pouring gate of ladle 41.

Figure 2:
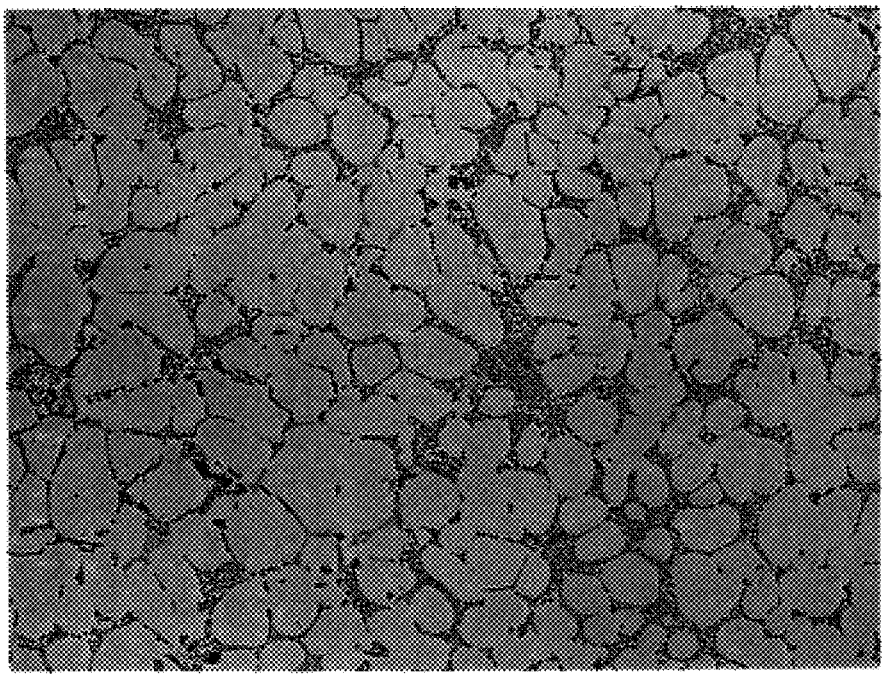
FIG. 2 is a metallurgical microscope photograph showing the particle structure of semi-molten metal in casting sleeve.

Then, the temperature of the molten metal is lowered in the casting sleeve 2 from a temperature near liquid phase line to a temperature around 580° C. (lower than liquid phase line and higher than solid phase line) or eutectic so as to form a spherical structure as show n in FIG. 2. In an A357 alloy, it is preferable to fix the cooling speed of the casting sleeve 2 from 0.5 to 8 K/s, and preferably 1 to 4 K/s. Thereby, A357 alloy molten metal 1B becomes a semi-molten status where primary crystal is granulated. As for crystal grain at this moment, the average of spherical degree (ratio of long diameter and short diameter of grain) is 0.63, and the average of circle equivalent diameter (diameter of pseudo-circle calculated from grain area) is 80 $\mu$m.

Figure 3:
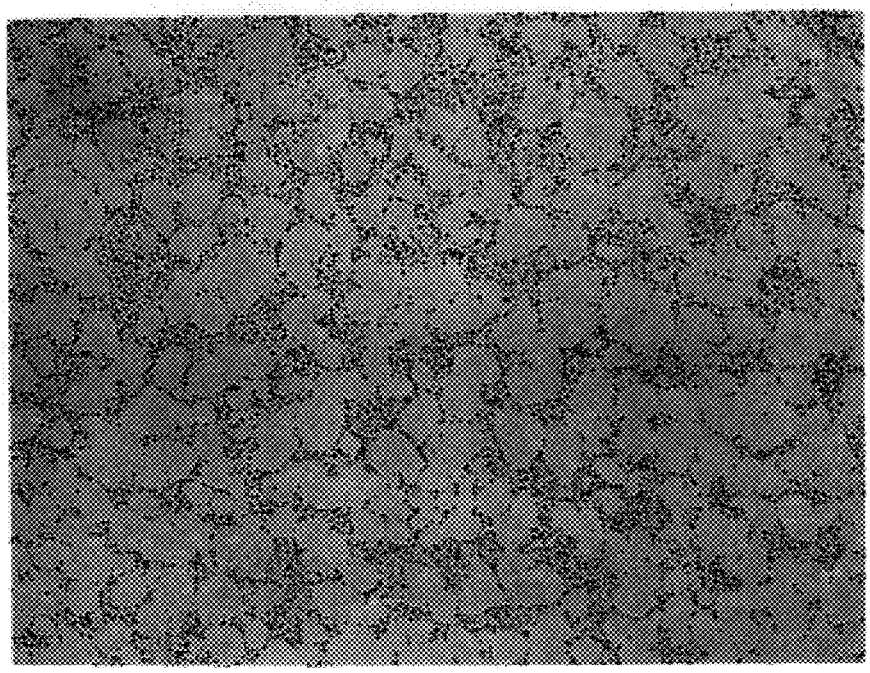
FIG. 3 is a metallurgical microscope photograph showing the spherical structure of casting after filling and solidification of the molten metal in the die cavity.

Next, semi-molten metal 1B of A357 having granular primary crystal is filled into a die cavity under pressure by use of plunger 3, maintaining a laminar flow condition. Granular structure becomes finer and changes into spherical structure at gate 6B during the process of filling and pressurizing the molten metal. The structure of the molten metal after passing the gate is shown in FIG. 3. The average of spherical degree (ratio of long diameter and short diameter of grain) of crystallized grain is 0.72, while the average of circle equivalent diameter (diameter of pseudo-circle calculated from grain area) is 40 $\mu$m. From FIG. 3, it is clear that after semi-molten metal structure is granulated in the casting sleeve and filled into die cavity, spherical degree (ratio of long diameter and short diameter of grain) becomes large, and circle equivalent diameter (diameter of pseudo-circle calculated from grain area) becomes small, and crystal is fine and almost circular.

The solid phase fraction of semi-molten metal 1B in the casting sleeve 2 is preferred to be 30 to 60% from the condition diagram and temperature of Al—Si—Mg system aluminum alloy. Raw material for a steering knuckle can be obtained by filling the semi-molten metal 1B in the casting sleeve 2 into the die cavity 6 under pressure and solidifying this molten metal, and then opening the die. Then, by heating this raw material up to a temperature around 540° C., segregation at casting is removed, and crystallization phase , deposition phase and the like are dissolved a matrix phase, and the molten metal is changed into an oversaturated solid solution. And then, said oversaturated solid solution is heated up to a relatively low temperature around 160° C., kept, and separation is facilitated by age hardening process.

Figure 4:
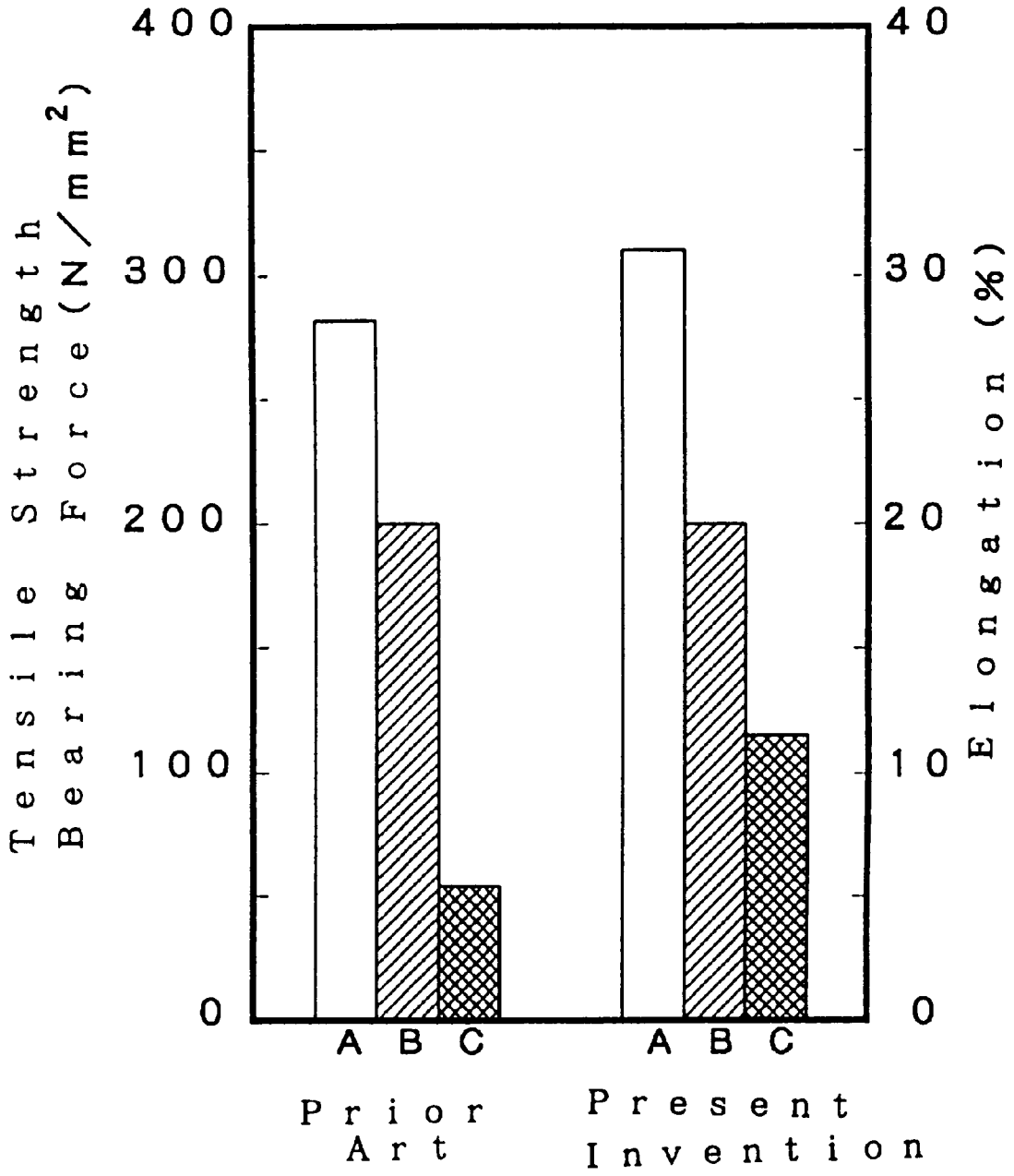
FIG. 4 is a diagram showing the mechanical characteristics of aluminum alloy castings of an example of the present invention and a conventional example.
Figure 5:
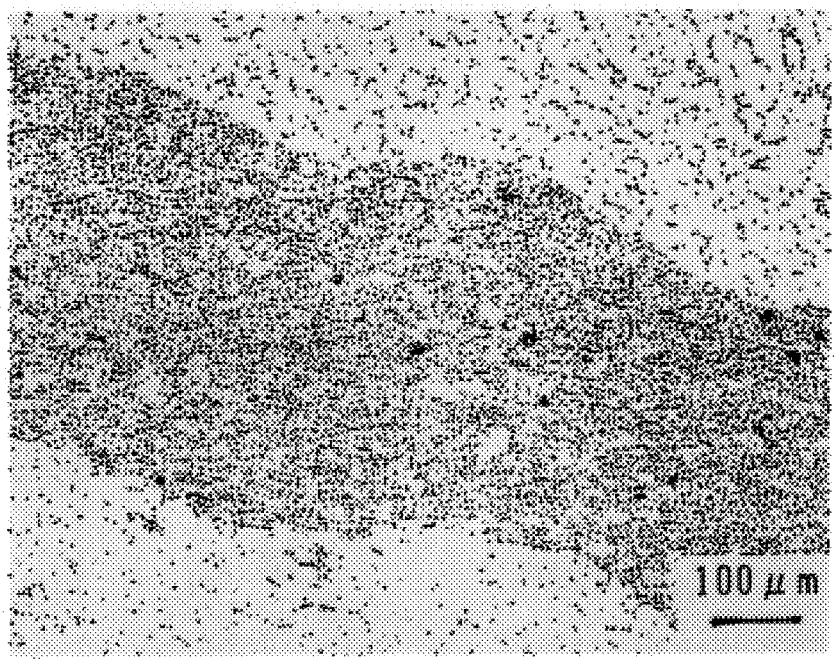
FIG. 5 is a metallurgical microscope photograph of the structure showing segregation of casting defect.
Figure 6:
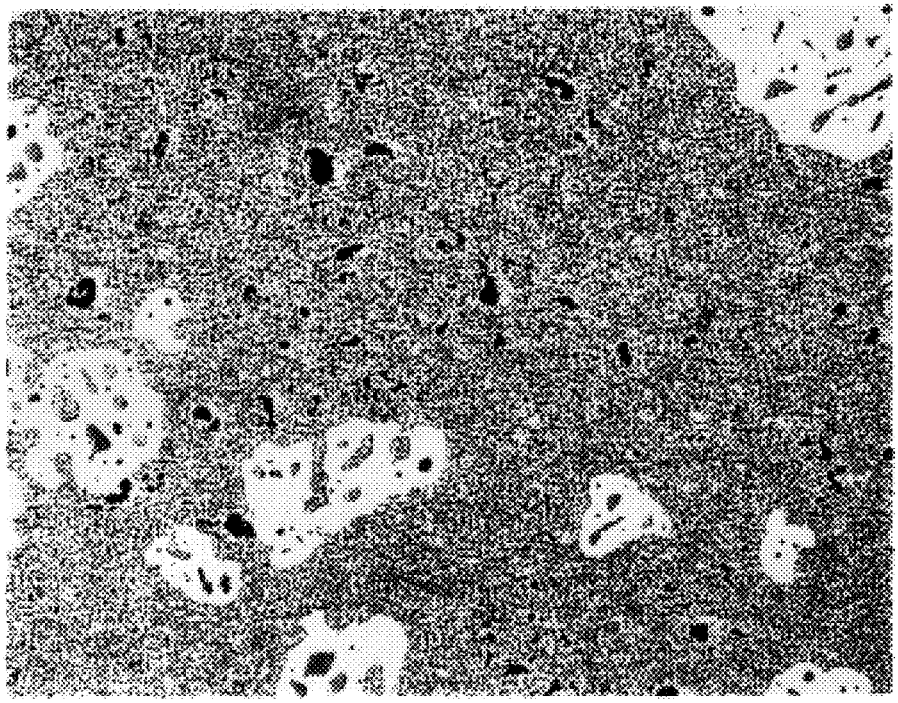
FIG. 6 is a metallurgical microscope photograph of the structure showing segregation owing to a large difference of solute concentration.

Comparing the mechanical characteristics of aluminum alloy castings of the present invention obtained in the above examples with those of conventional aluminum alloy castings, the mechanical characteristics of aluminum alloy castings of the present invention showed excellent characteristics in tensile strength (A), bearing force (B), and elongation (C), as shown in FIG. 4.

The mechanical characteristics of the products formed by the aluminum alloy casting of the present invention were compared with casting by the comparative pressure forming method after re-heating and conventional aluminum alloy casting. The results are shown in TABLE 1.

TABLE 1

| | Tensile strength ($N/mm^2$) | Bearing force ($N/mm^2$) | Elongation (%) |
|---|---|---|---|
| Example | 350 | 280 | 10 |
| Comparative example (re-heating) | 320 | 260 | 7 |
| Conventional example | 345 | 270 | 8 |

As shown in TABLE 1, the aluminum alloy casting of the example according to the present invention has excellent characteristics in both tensile strength and elongation compared with the aluminum alloy castings of the comparative example and the conventional example.

EXAMPLE 2

Next, experiment was carried out by the same casting method as Example 1 with changed solid phase fraction of semi-molten metal in the casting metal. The mechanical characteristics of a steering knuckle obtained through heat processing are shown in TABLE 2.

TABLE 2

| Mechanical characteristics | | | | |
|---|---|---|---|---|
| Solid phase fraction (%) | Tensile strength ($N/mm^2$) | Bearing force ($N/mm^2$) | Elongation (%) | Appearance after heat processing |
| 25 | 329 | 280 | 1.8 | With small blisters |
| 35 | 347 | 275 | 8 | |
| 45 | 353 | 277 | 10 | |
| 55 | 350 | 282 | 9 | |
| 65 | 330 | 274 | 3.1 | Insufficient flow |

Semi-molten metal filled from a casting sleeve into the die cavity with solid phase fraction of 25% shows small blisters and short elongation after heat processing. Therefore, it is not appropriate for a steering knuckle that requires toughness.

Figure 11:
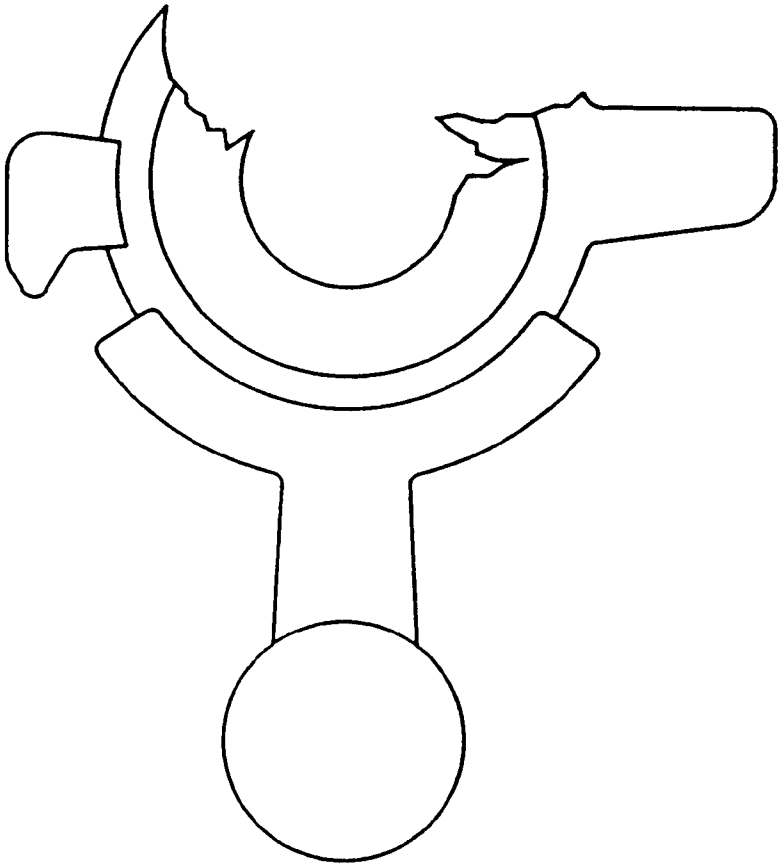
FIG. 11 is a top view showing insufficient flow in knuckle steering.

Semi-molten metal filled from the casting sleeve into a die cavity with solid phase fraction of 65% shows insufficient flow as shown in FIG. 11, and therefore, cannot be applied to product. Accordingly, it is clear that in the range of 30% to 60% of solid phase fraction molten metal flow is good, only a few blisters occur, and tensile strength, bearing force, and elongation are excellent. By producing the suspension part for automobiles such as steering knuckle by this die casting method, higher reliability and lighter weight can be obtained.

And when part of the inner cylinder of the casting sleeve 2 is formed from a low thermal conductor SIALON, semi-molten metal 1B is kept warm, and semi-molten granular structure can be obtained without preheating the casting sleeve 2.

Further, by reducing the pressure in the interior of the die cavity 6 during the process of filling the molten metal into the die cavity, molten metal flow is further improved, and semi-molten metal can be filled to the end of the die cavity.

In addition, by supplying inert gas into the casting sleeve 2, oxidation of molten metal is prevented, and further flawless casting can be obtained.

EXAMPLE 3

Figure 7:
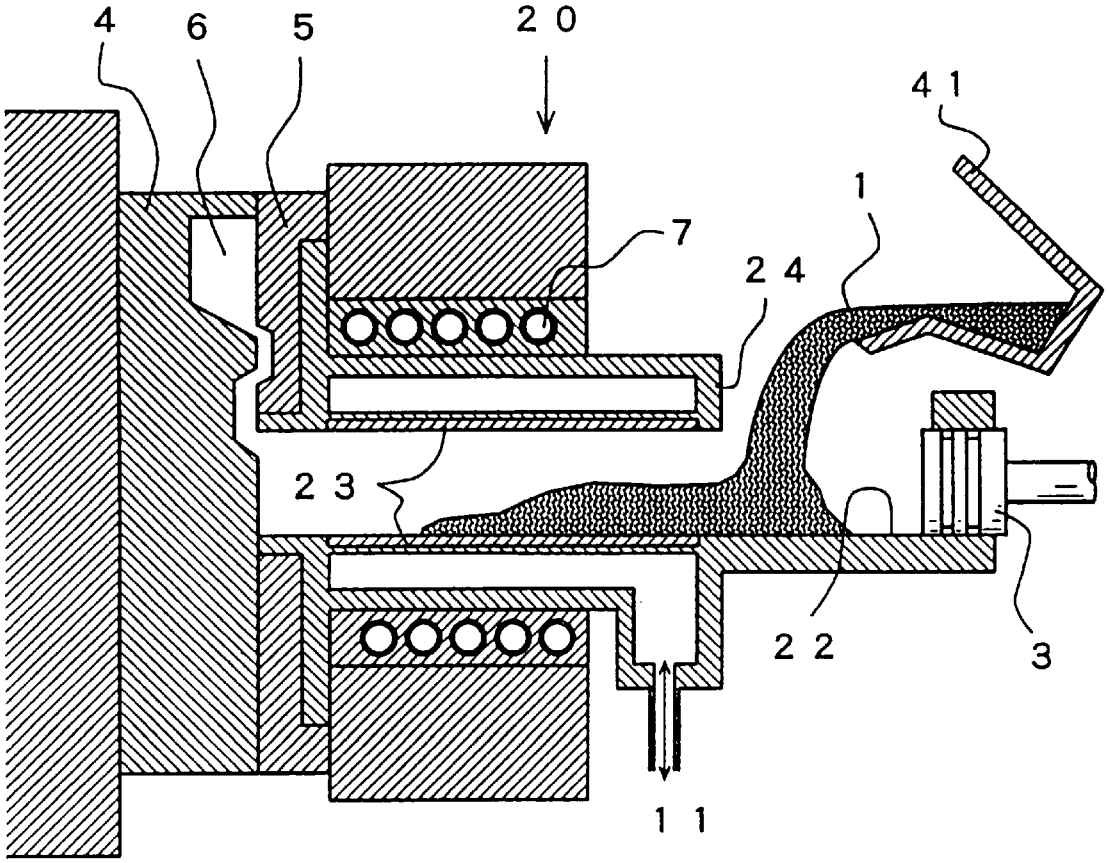
FIG. 7 is a diagram showing cross section of an important portion of a horizontal die casting machine of another example to be used in the die casting method under the present invention.
Figure 8:
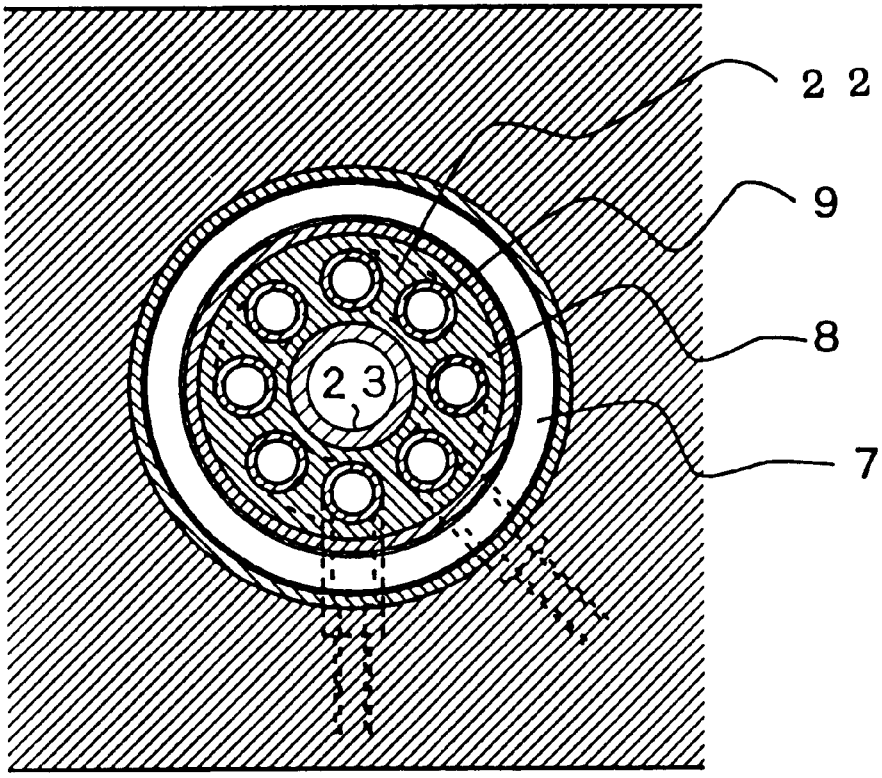
FIG. 8 is a diagram showing cross section of the portion 20 in FIG. 2.

FIG. 7 shows a cross section of an important part of a horizontal die casting machine to be used in a die casting method of another example of this invention, while FIG. 8 shows a cross section of the portion 20 in FIG. 7. The horizontal die casting machine in FIG. 7 comprises mainly of casting sleeve 22 which comprises of outer cylinder 24 and inner cylinder to receive molten metal 1, plunger 3 driven by a hydraulic unit, and die cavity 6 to where said plunger 3 moves to the left and fills molten metal 1 of casting sleeve 22.

In FIG. 7 and FIG. 8, the inner cylinder of the casting sleeve 22 comprises of insulator 8 formed by SIALON ceramic 23, where conductors 9 made of discontinuous austenite stainless steel pipes are embedded discontinuously, and cooling water 11 runs through conductors 9. In place of water cooling, air cooling can also be applied. By the conductor 9 and induction coil 7 of the casting sleeve 22, electromagnetic force is generated, and semi-molten metal in the casting sleeve is filled into the die cavity without contacting the inner wall. The occurrence of solidified debris is limited, and the temperature decrease of molten metal is small, and temperature distribution is uniform.

The pressure of the model die casting machine is 100 MPa, and the inner diameter of casting sleeve 22 is 50 mm, and the outer diameter is 80 mm. Die cavity 6 is formed by movable die 4 and fixed die 5 so as to cast steering knuckle for automobile.

By use of this horizontal die casting machine, A357 raw material is cast in the same manner as in Example 1, and heat processing is carried out. The comparative results of the mechanical characteristics of steering knuckle produced as described above and those of steering knuckle produced by conventional low pressure casting method are shown in TABLE 3.

TABLE 3

| | Mechanical characteristics | | |
|---|---|---|---|
| Casting method | Tensile strength ($N/mm^2$) | Bearing force ($N/mm^2$) | Elongation (%) |
| Present Invention | 348 | 283 | 11 |
| Comparative example (low pressure casting) | 320 | 270 | 3 |

From the example of the present invention shown in TABLE 3, it is understood that molten metal flow is good, blisters are few, and steering knuckle with superior tensile strength, bearing force, and elongation can be obtained compared with the comparative example of conventional low pressure casting method. By producing suspension part for automobiles knuckle by this casting method, higher reliability and lighter weight can be obtained.

Figure 9:
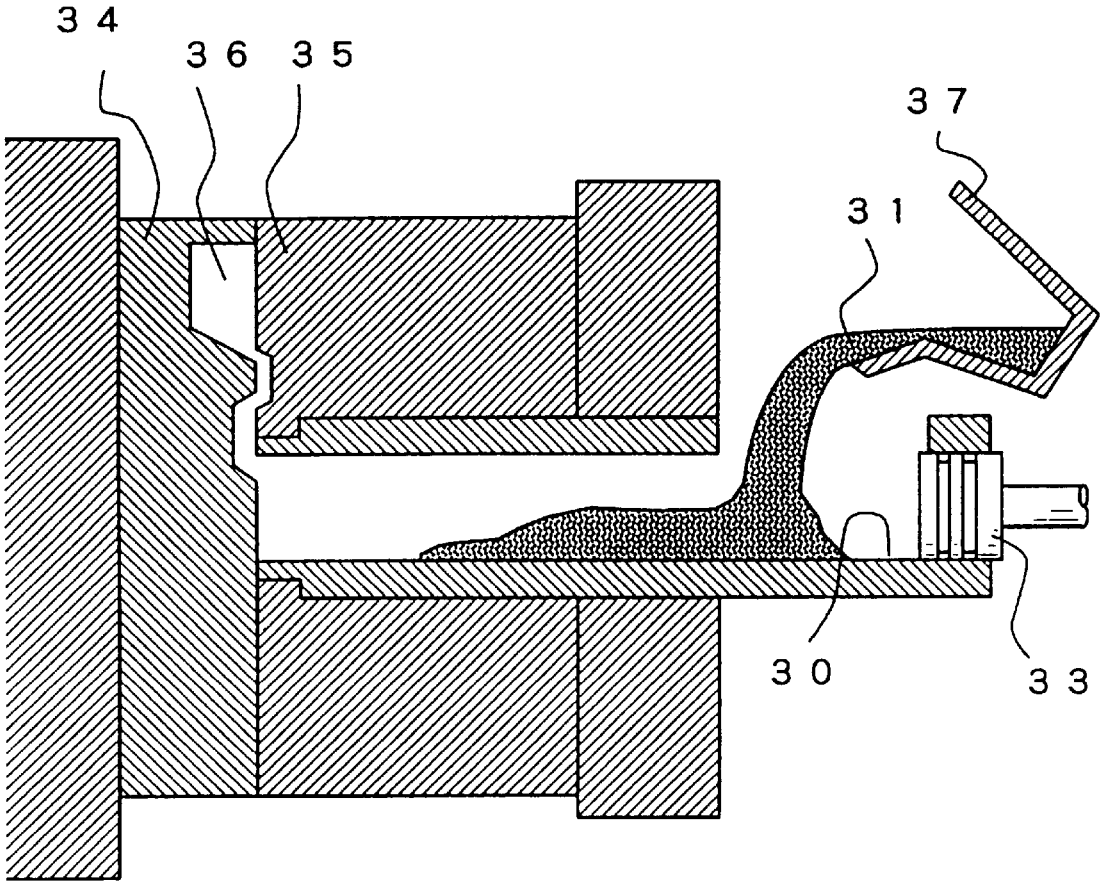
FIG. 9 is a diagram showing cross section of an important portion of a horizontal die casting machine without electromagnetic body force of another example to be used in the die casting method under the present invention.
Figure 10:
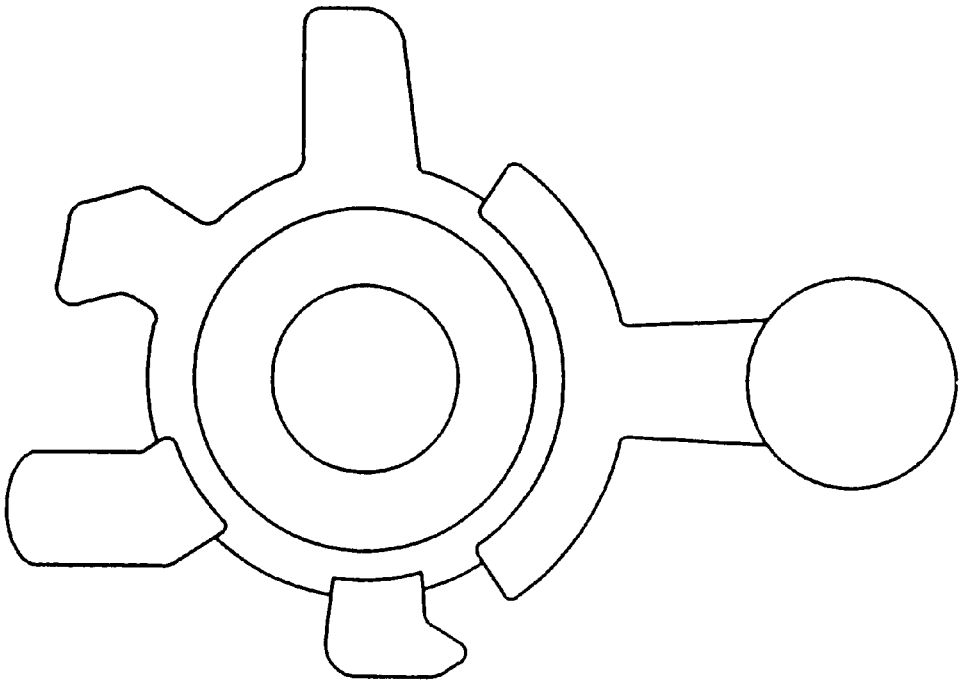
FIG. 10 is a top view showing knuckle steering.

According to the characteristics of casting part to be produced, die casting machine shown in FIG. 9 may be used in place of the die casting machine explained in this example. The die casting machine shown in FIG. 9 comprises mainly of casting sleeve 30 to receive molten metal 31 poured from ladle 37, die cavity 36 formed by upper die 34 and lower 35, and plunger 33 to charge the molten metal in the casting sleeve into the die cavity.

As described above in detail, in the die casting method of the present invention, primary crystal of molten metal is substantially granulated in the casting sleeve so as to form a semi-molten status and then filled into the die cavity under pressure and then solidified, so that molten metal flow becomes a laminar flow. Therefore, air mixing is reduced, and casting can be produced without oxides and solidified matter being filled into die cavity. The aluminum alloy casting obtained by such a die casting method has excellent mechanical characteristics, and its characteristics are uniform, and therefore, it can be preferably applied to high hardness portions such as suspension unit including steering knuckle and aluminum wheel of automobile.

As this invention may be embodied in several forms without departing from the spirit of essential characteristics thereof, the present examples are therefore illustrative and not restrictive, since the scope of the invention is defined by the appended claims rather than by the description preceding them, and all changes that fall within meets and bounds of the claims, or equivalence of such meets and bounds are therefore intended to embraced by the claims.

What is claimed is:

1. A die casting method comprising the steps of:

granulating primary crystals of molten metal, by setting a cooling speed over 0.5 K/s and below 10 K/s without stirring, at a temperature below the liquid phase line above the solid phase line of said metal, is a casting sleeve so as to form a semi-molten state, filling the metal under pressure in its semi-molten state into a die cavity, and solidifying said metal.

2. A die casting method set forth in claim 1, wherein at least part of inner cylinder of the casting sleeve is formed of low thermal conducting material.

3. A die casting method set forth in claim 1, wherein the inside of said die cavity is formed at reduced atmosphere and inert gas atmosphere at least when semi-molten metal is being filled into said die cavity.

4. A die casting method set forth in claim 2, wherein the inside of said die cavity is formed at reduced pressure and inert gas atmosphere at least when semi-molten metal is being filled into said die cavity.

5. The die casting method of claim 1, further comprising the step of setting a temperature of the casting sleeve to above 200° before said step of granulating primary crystals of molten metal.

6. A die casting method comprising the following processes:

(a) melting metal and controlling the temperature at a temperature near liquid phase line, (b) transferring said molten metal into a casting sleeve, and lowering the temperature of said molten metal in the casting sleeve from a temperature near liquid phase line to a specified temperature lower than liquid phase line and higher than solid phase line or eutectic line by setting a cooling speed over 0.5 K/s and below 10 K/s, thereby granulating primary crystals of the molten metal, without stirring, substantially so as to form a semi-molten state, (c) filling under pressure the semi-molten metal having granulated primary crystals into a die cavity, and (d) solidifying said molten metal tilled into said die cavity. thermal conducting material.

7. A die casting method set forth in claim 6, wherein at least part of inner cylinder of the casting sleeve is formed of low thermal conducting material.

8. A die casting method set forth in claim 2, wherein the inside of said die cavity is made into decompressed atmosphere and/or inert gas atmosphere at least when semi-molten metal is being filled into said die cavity.

9. A die casting method set forth in claim 7, wherein the inside of said die cavity is formed at reduced pressure and inert gas atmosphere at least when semi-molten metal is being filled into said die cavity.

10. A die casting method set forth in any one of claims 1,6,2,7 or 3,8,4,9, wherein the inside of said casting sleeve is filled with an inert gas atmosphere.

11. The die casting method of claim 6, further comprising a process of, before process (b), setting a temperature of the casting sleeve to above 200°.

12. A die casting method set forth in claim 6, further comprising, during step (b), controlling a solid phase fraction of the semi-molten metal so that said solid phase fraction ranges between 30% and 60%.

13. A die casting method comprising the steps of:

granulating primary crystals of molten metal, by setting a cooling speed over 0.5 K/s and below 10 K/s without stirring, at a temperature below the liquid phase line but above the solid phase line of said metal, in a casting sleeve so as to form a semi-molten state, filling the metal under pressure in its semi-molten state into a die cavity, while maintaining laminar flow at the semi molten metal, thereby obtaining granular particles having average spherical degree higher than 0.63; and solidifying said metal.

14. The die casting method of claim 13, further comprising the step of setting a temperature of the casting sleeve above 200° before said step of granulating primary crystals of molten metal.

15. A die casting method comprising the steps of:

granulating primary crystals of molten metal, by setting a cooling speed over 0.5 K/s and below 10 K/s without stirring, at a temperature below the liquid phase line but above the solid phase line of said metal, in a casting sleeve so as to form a semi-molten state, filling the metal under pressure in its semi-molten state into a die cavity, while maintaining laminar flow of the semi molten metal, thereby obtaining granular particles having average spherical degree of about 0.72; and solidifying said metal.

16. The die casting method of claim 15, further comprising the step of setting a temperature of the casting sleeve to above 200° before said step of granulating primary crystals of molten metal.

17. A die casting method comprising the steps of:

granulating primary crystals of molten metal, at a temperature below the liquid phase line but above the solid phase line of said metal, by setting a cooling speed over 0.5 K/s and below 10 K/s, in a casting sleeve so as to form a semi-molten state, filling the metal under pressure in its semi-molten state into a die cavity, and solidifying said metal.

18. A die casting method set forth in claim 17, further comprising, during said step of filling, controlling a solid phase fraction of the semi-molten metal so that said solid phase fraction ranges between 30% and 60%.

* * * * *